US009144829B2

(12) United States Patent
Billings

(10) Patent No.: US 9,144,829 B2
(45) Date of Patent: Sep. 29, 2015

(54) ORGANIZING PATHOLOGY ASSETS

(71) Applicant: Iron Mountain Incorporated, Boston, MA (US)

(72) Inventor: Erik Billings, Boston, MA (US)

(73) Assignee: Iron Mountain Incorporated, Boston, MA (US)

( * ) Notice: Subject to any disclaimer, the term of this patent is extended or adjusted under 35 U.S.C. 154(b) by 80 days.

(21) Appl. No.: 13/910,770

(22) Filed: Jun. 5, 2013

(65) Prior Publication Data

US 2013/0319914 A1 Dec. 5, 2013

Related U.S. Application Data

(60) Provisional application No. 61/655,695, filed on Jun. 5, 2012.

(51) Int. Cl.

| | |
|---|---|
| ***B07C 7/04*** | (2006.01) |
| ***B07C 7/00*** | (2006.01) |
| ***B07C 5/00*** | (2006.01) |

(52) U.S. Cl.

CPC .... *B07C 7/00* (2013.01); *B07C 5/00* (2013.01)

(58) Field of Classification Search

USPC ..... 209/552, 701, 702, 942

See application file for complete search history.

(56) References Cited

U.S. PATENT DOCUMENTS

| | | | | |
|---|---|---|---|---|
| 4,809,158 | A * | 2/1989 | McCauley | 1/1 |
| 5,445,037 | A | 8/1995 | Itoh | |
| 7,984,809 | B1 * | 7/2011 | Ramey et al. | 209/546 |
| 8,346,574 | B2 | 1/2013 | Chirica et al. | |
| 8,463,741 | B2 | 6/2013 | Ehlke et al. | |
| 2004/0031732 | A1 * | 2/2004 | Whitnable | 209/584 |

* cited by examiner

*Primary Examiner* — Terrell Matthews
(74) *Attorney, Agent, or Firm* — BainwoodHuang

(57) ABSTRACT

A technique for organizing pathology samples includes sorting the samples into bins defined at different physical locations of a sorting apparatus, based on a set of designations applied to the samples. With such an arrangement, unorganized pathology samples may be grouped so that all the same accession numbers are grouped together for efficient filing or re-filing with reduced error. An apparatus suitable for use according to this technique includes a support structure and multiple dividers defining multiple sets of bins on the apparatus. A different set of bins is provided on the apparatus for each of the set of designations applied to the samples.

7 Claims, 5 Drawing Sheets

ORGANIZING PATHOLOGY ASSETS

CROSS REFERENCE TO RELATED APPLICATIONS

This patent application claims the benefit of U.S. Provisional Patent Application No. 61/655,695 filed on Jun. 5, 2012, entitled, "ORGANIZING PATHOLOGY ASSETS", the contents and teachings of which are hereby incorporated by reference in their entirety.

BACKGROUND

In the context of pathology material storage, an accession number typically identifies a tissue sample within a slide or a block using a format such as XX-YY-ZZZZ where XX is a prefix which identifies the lab source, YY identifies the year, and ZZZZ identifies the particular matter (or case) number. For example, a slide or a block which is labeled "SU-07-1234" indicates that the slide or block originated from a surgery ("SU") laboratory and is the 1234th case in 2007 from that laboratory. There may be more than a single slide, or block, that has the same accession number.

When a laboratory returns loose slides and/or blocks to a facility for storage, a person at the facility manually arranges the loose slides and/or blocks into groups based on accession numbers, and then stores the groups in boxes or other containers for later retrieval.

SUMMARY

Unfortunately, existing manual processes for organizing loose slides and/or blocks are prone to human error. For example, people who arrange pathology slides and blocks (generally, "assets" or "samples") into groups for storage typically rely on their memory and their own ability to keep track of where they are in the arranging process. Pathology samples can easily be placed in the wrong groups or out of order if the person arranging the assets is interrupted or distracted. Samples can be grouped with the wrong prefix, year and/or case number). Once an item is filed (or re-filed) in a wrong grouping, the item may be placed in an improper container and become virtually impossible to find later. Pathology samples may have to be recovered from storage and re-examined for many reasons, including baseline comparisons for later pathology sample evaluations, disease diagnosis, as evidence in legal disputes, and for scientific studies. The consequences of misfiling pathology assets can thus be severe, as some misfiled assets may be irreplaceable. The presence of more than a single sample having the same accession number may make this problem even more challenging.

In contrast with the above-described prior manual approach, an improved technique of organizing pathology samples includes sorting the samples into bins defined at different physical locations of a sorting apparatus, based on a set of designations applied to the samples.

In an example, the apparatus is referred to as an Interfiler. Use of an Interfiler facilitates performance of an iterative sorting operation which sorts pathology assets into smaller subgroups in a robust and reliable manner. The Interfiler apparatus includes different sets of dividers (e.g., from left to right) which enable a user to distribute (or separate) the assets based on different sorting criteria for efficient and error free storage and retrieval. For example, the Interfiler apparatus is capable of guiding the user to initially sort assets based on prefix (i.e., laboratory abbreviations), decade (2010s, 2000s, 1990s, 1980s etc. . . . ), year digit (0, 1, 2, 3, 4, 5, 6, 7, 8 and 9), particular sequence number (1-10,000+), and so on. In an iterative manner, the user transfers the assets from larger groupings to smaller groupings using the dividers until the user has gathered the assets into the smaller subgroups in an aggregation area. The user is then able to aggregate the organized assets, and safely store the aggregated/organized assets in an error free manner for subsequent retrieval. Using such a technique, the user does not need to rely on memory of accession numbers, or inconsistent and unstructured attempts to manually group material.

In some illustrative embodiments, an apparatus for sorting pathology samples may include a support structure such as a table or set of shelves. The support structure may include a set of physical dividers forming multiple bins for sorting pathology samples. The bins may be organized in groups based upon sorting criteria. For example, a first set of bins may be located near the left side of the support structure and labeled for a first sorting criterion, such as laboratories from which tissue samples arrive. Examples of possible laboratories include surgery, cytology, pathology, morgue, epidemiology, or research. The first set of bins may be made larger than other bin sets. A second set of bins may be located adjacent to the first set of bins and labeled for a second sorting criterion, such as decades in which samples are taken. A third set of bins may be located adjacent to the second set of bins and labeled for a third sorting criterion, such as 1-digit years in which samples are taken. Typically, the bins in the third set of bins are smaller than the bins in the second set of bins, and the number of bins in the third set of bins may be greater than the number of bins in the second set of bins. A fourth set of bins may be labeled for a fourth sorting criterion, such as the identification number of the patient from which the sample is obtained. Any number of sets of bins for different sorting criteria may be used, and the sizes and numbers of the bins may be adjusted to fit the need.

In some illustrative embodiments, a method for handling pathology samples includes receiving a set of unordered labeled pathology samples and sorting the pathology samples into multiple sets of bins at physical locations on a sorting apparatus. Each set of bins may be defined to provide sorting locations for a different designation field, for example a patient identification field or a sample origin year. Each individual bin provides a sorting location for a different value range of the designation field of that set of bins. This illustrative method may be performed in different ways, including a simple sequential method and a parallel iterative method.

Such an arrangement provides improved accuracy of pathology sample asset filing, while allowing temporary work stoppage without loss of filing order. Use of movable bins may improve ease of organized pathology sample storage. The present apparatus and methods allow for error-free ordering of pathology samples in such a fashion that the samples may be recovered and re-filed with greatly reduced risk of human error, such that pathology samples can be more reliably retrieved.

BRIEF DESCRIPTION OF THE DRAWINGS

The foregoing and other objects, features and advantages will be apparent from the following description of particular embodiments of the invention, as illustrated in the accompanying drawings in which like reference characters refer to the same parts throughout the different views. The drawings are not necessarily to scale, emphasis instead being placed upon illustrating the principles of various embodiments of the invention. In the accompanying figures.

DETAILED DESCRIPTION

Figure 1:
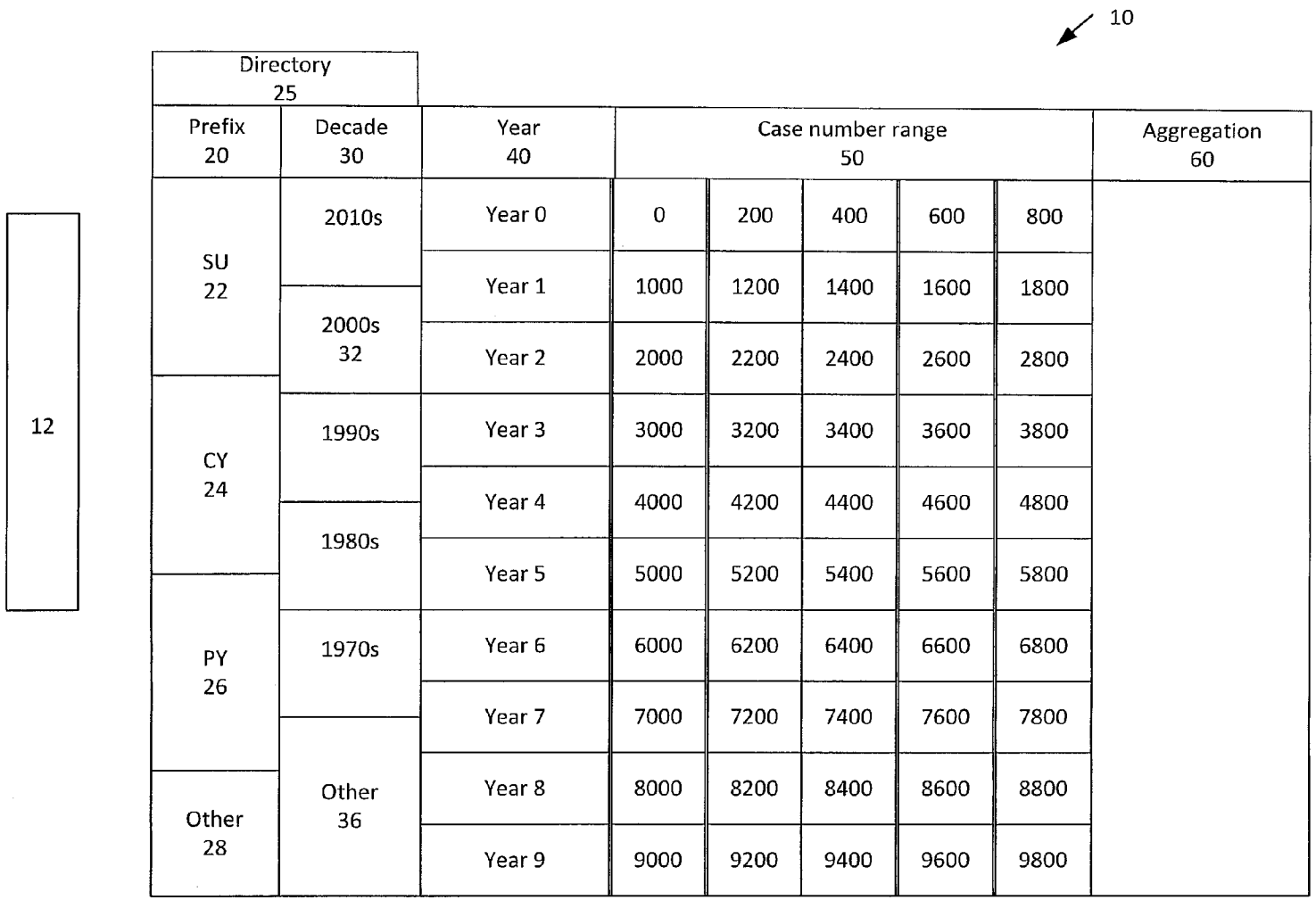
FIG. 1 is a top view of an illustrative pathology asset sorting apparatus.

An improved technique for organizing pathology samples includes sorting the samples into bins defined at different physical locations of a sorting apparatus, based on a set of designations applied to the samples. An apparatus suitable for use according to this technique includes a support structure and multiple dividers defining multiple sets of bins on the apparatus. A different set of bins is provided on the apparatus for each of the set of designations applied to the samples.

An example method of organizing pathology assets includes receiving a group of pathology assets. Each pathology asset includes (i) a sample portion which stores a pathology sample (e.g., a block or slide containing a tissue sample) and (ii) an asset identification portion which identifies that pathology asset among other pathology assets (e.g., a label affixed to the block or slide). The method further includes performing an iterative sorting operation to sort the group of pathology assets into smaller subgroups and, based on results of the iterative sorting operation, storing the smaller subgroups in ordered/aggregated configurations (e.g., in boxes, in specialized pathology tissue containers/files, etc.).

An example apparatus for organizing pathology assets includes a set of first dividers (e.g., trays, slots, etc.), a set of second dividers, and a support structure which maintains the set of first dividers in a first fixed arrangement, and the set of second dividers in a second fixed arrangement adjacent the first fixed arrangement. The apparatus is constructed and arranged to receive a group of pathology assets, facilitate performance of an iterative sorting operation to sort the group of pathology assets into smaller subgroups and, based on results of the iterative sorting operation, combine the smaller subgroups together and manage them for storage.

The iterative sorting operation includes distributing the pathology assets of the group among a set of first dividers (i.e., one or more dividers) based on application of a first sorting criteria to the asset identification portions of the pathology assets to separate the group of pathology assets into subgroups. Additionally, the iterative sorting operation includes distributing a subgroup of pathology assets from one of the first dividers among a set of second dividers based on application of a second sorting criteria to the asset identification portions of the pathology assets to separate the subgroup of pathology assets into the smaller subgroups, and so on.

Other embodiments are directed to systems, assemblies, devices, etc. Some embodiments are directed to various methods, components and articles of manufacture which are involved in organizing pathology assets for storage.

Improved hardware and workflow steps help organize pathology slides and blocks (referred to herein as "assets," "samples," and/or "materials") in an efficient and error free way. It should be understood that pathologists, residents, scientists, researchers, etc., retrieve selected materials from boxes containing many slides and blocks. These materials have a unique identifier generally called an accession number, e.g. "SU-07-1234", identifying the 1234th surgery case in 2007 from that laboratory. There are usually multiple slides and multiple blocks associated with one accession number.

The accession numbers will typically have different prefixes (SU, CS, etc. . . . ), different years and different numbers. When materials are returned to storage to be re-filed (i.e., re-stored) for possible later retrieval, the blocks and slides can be in random order, meaning each slide and each block needs to be grouped with other items from each accession number.

The Interfiler apparatus provides an organizer board laid out in a particular direction (e.g., from left to right) that can be disposed horizontally (e.g. on a table) or vertically (e.g. on a rack) or in another orientation (e.g., obliquely), with multiple columns of dividers which are constructed and arranged to hold slides and/or blocks.

FIG. 1 is a top view of an example pathology asset sorting apparatus 10, in accordance with an embodiment of the present disclosure. The pathology sorting apparatus 10 may be used to arrange a group of unordered pathology assets 12, which may include blocks, slides, liquids in various containers such as test tubes and vials, tissue samples, analysis and computation results, such as genetic listings, chemical compositions, bacteria cultures, bodily specimens, genetic material, and the like. The shown divisions form bins, which may be formed using physical dividers. The dividers may be permanently built into a support structure, for example a table, or they may be movable to improve flexibility. Alternatively, bins may be formed from separate containers for ease of reorganization. In general, the bins should be capable of holding the pathology assets securely. The bins may include a non-slip soft surface. Special holders may be provided for pathology samples that may need to be kept in a specific orientation, for example, vials, which should be kept upright.

Sorting apparatus 10 as shown in FIG. 1 includes multiple sets of bins. Each set of bins has a label and provides a sorting location for pathology samples according to a particular designation field. The different sets of bins thus represent the different fields of accession numbers with which samples are labeled.

A first set of bins, shown as totaling four in this illustrative example, may be labeled with a label 20 identifying a first sorting designation field, for example an indicator of the location of origin of assets. The label 20 may be known as a "prefix." In this illustrative example, the different bins of the first set of bins indicate the laboratories of origin of the pathology samples, for example surgery (i.e., SU 22), cytology (i.e., CY 24), pathology (i.e., PY 26), or Other 28. The number of bins in the first set of bins may be adjusted as needed. The prefix 20 may be an alphanumeric value, as shown in the figure, or it may be a simple number. The prefix 20 may include geographical indicators, for example, CA for California or Mt Hol for Mount Holyoke Hospital, or other easily imagined alphanumeric values.

The pathology sorting apparatus 10 has a second set of bins, which may have a designation field label 30, shown in the figure as indicating different decades, which correspond to the decade of origin of the pathology asset or sample. The number of second bins need not be limited by the six shown bins, and may depend upon the normal age range of the received samples. If the received pathology samples are rarely more than 9 years old, then the benefit of having a decade indicator (2010s, 2000s, 1990s, 1980s etc. . . . ) may not be sufficient to overcome the amount of space on the support structure taken by a decade designation set of bins, and it may be removed. The number of rows and the number of bins may be adjusted as needed.

The pathology sorting apparatus may have a third set of bins, which may have a designation field label 40, shown in the figure as indicating different 1-digit years, which correspond to the years of origin of the assets. Since the Year digit indicator is limited to (0, 1, 2, 3, 4, 5, 6, 7, 8, 9) in the case where there is a prior decade designator, it is likely that the selected number of bins in the third set of bins will generally equal 10, as shown in the figure, but the invention is not so limited. It is also likely that the probable increased number of bins in the third set of bins may limit the size of each individual bins to a smaller size that those of the second set of bins, but the invention is not so limited, and two or more rows of Year 40 bins may be used with any size bin as needed.

The pathology sorting apparatus 10 may have a fourth set of bins, which has a designation field label 50, shown in the figure as indicating what may be known as an case number range. In this illustrative example, the case number range corresponds to a numerical indication of the order in which pathology samples were generated in the year of origin of the asset, and is shown for simplicity as being between 1 and 10,000, but there is no limit on how many pathology assets may be produced in a given year by a specific laboratory. Large laboratories such as the National Institutes of Health may produce larger numbers of samples than those shown. In the case of very large numbers of samples the disclosed arrangement may use an intermediate set of bins designating a field for the month of the year in which the sample originated, located between the third set of bins and the fourth set of bins (as designated by the year designation field 40 and the case number range designation field 50). In this illustrative example the fourth designation field is organized in five vertical rows of ten rows, but the invention is not so limited. The 50 shown bins of the fourth set of bins are each preferably large enough to hold more than a single pathology sample during sorting.

The pathology sorting apparatus 10 may have a fifth area (or set of bins, shown in FIG. 1 as a single bin for simplicity), which may have a designation field label 60 as indicating an aggregation area. The aggregation area may be used to place samples held in the case number range bins in a selected order, for example numerical order.

It should be understood that the bins in Prefix column may be larger than the bins in the decade designation column. Likewise, the bins in decade column may be larger than the bins in the year designation column. Additionally, the bins in the year column are larger than the bins in the case number region. The aggregation area is an open workspace (e.g., defined by one or more dividers or trays) which enables a user of the Interfiler apparatus 10 to handle and maneuver the materials more freely (e.g., to aggregated stacks of assets) prior to removing the materials from the apparatus 10 and placing the materials in a storage container.

Figure 2:
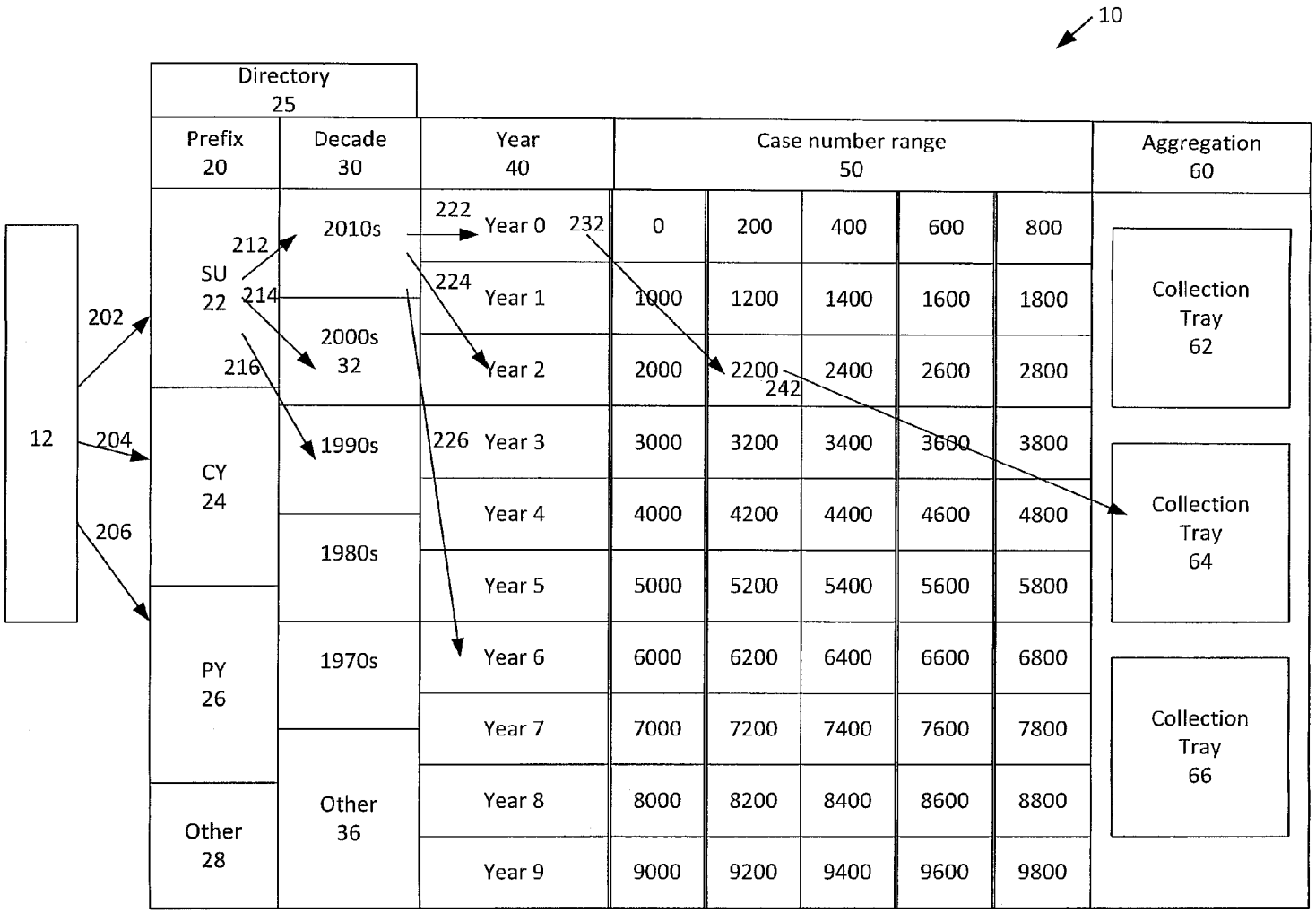
FIG. 2 is a top view showing an illustrative work flow of the sorting apparatus.

FIG. 2 is a top view showing an illustrative work flow of the sorting apparatus 10. Details of how a user may operate the Interfiler apparatus 10 will now be provided. The Interfiler apparatus 10 may include a directory 25 (i.e., a set of instructions) on how to parse the accession number format. Accordingly, the Interfiler apparatus is suitable for use to organize pathology sample materials from a variety of sources, such as different companies, hospitals and/or laboratories. The directory may allow sorting even if the accession number formats are different, for example a format such as XX-YY-ZZZZ, where YY identifies a two digit year, XX identifies a laboratory and ZZZZ is a four digit sequence number, versus a format such as YYYY-XXXZZZ, where YYYY identifies a four digit year and XXXZZZZ identifies a three-letter lab abbreviation followed by a four digit sequence number, and so on.

During operation, the user is able to rely on the directory 25 rather than user's own memory. The directory 25 is capable of being posted (i.e., positioned on the Interfiler apparatus) openly and clearly in front of the user, e.g., on a two-dimensional surface along the side of the table furthest from the user and facing the user.

The user then begins the material organization process. Each pathology sample includes a slide or a block or other format, and an asset identification portion, for example a label, which identifies that pathology asset among other pathology assets. The user may read the asset identification portion, for example visually, electronically, or physically, in order to obtain the accession number and other designation field information.

A user many sort different types of materials at different times. For example, if both slides and blocks are found in the unordered pathology samples 12, and are to be filed or to be re-filed, the user may separate the slides from the blocks, and then further processes only one type of material at a time. The user may move all the slides to be sorted from location 12 into the indicated bins of the first set of bins as labeled with prefix 20, i.e., bins SU 22, CY 24, PY 26 or Other 28, as appropriate based upon the asset identification information. Alternatively, the user may move only the SU 22 marked samples, as shown by arrow 202, leaving other marked slides at location 12.

In the case where the user has moved all of the slides at location 12 into the first set of bins, as shown by arrows 202, 204 and 206, then the user may take all the slides from the first or top bin of the first set of bins (in this example, the SU 22 bin), and distribute the slides into one or more bins of the second set of bins (Decade 30 bins) based on their decade of origin as indicated by the label information, as shown by arrow 212. The user may typically leave the slides in the other Prefix 20 designation bins in place while further sorting and aggregating the first group of samples. Alternatively, the user may select only those samples from the first or top bin of the first (prefix) set of bins from the first decade (e.g., 2010's) and move those samples to the first (2010's) bin, leaving the other samples in the first (prefix) bin of the first set of bins until all samples for the first decade designation bin have been processed.

The user may then take the slides from the first bin of the second (decade) set of bins (in this example from the bin labeled 2010s at the top of the Decade 30 column) and either place each slide into their corresponding Year 40 designation bin (as shown by arrows 222, 224 and 226) until the decade designation bin is emptied, or only move those samples marked as being from year 0, as shown by arrow 222. Again, the user leaves the slides in the other (Decade) bins of the second set of bins in place while the user further organizes the slides from the first decade divider 2010s in either of the two described procedures.

The user may then take the slides from the first bin of the third (Year) set of bins and place them in the appropriate bins of the fourth set of bins, for case number range according to their labels (in this example the ZZZZ portion of the label information) as shown by the arrow 232. In some embodiments, the fourth set of bins may occupy multiple columns, for example 5 columns covering a range of 0-10,000. In this example, an asset in the Year 0 bin, having an case number in the range of 2200-2399 should go in the bin labeled 2200, as shown by arrow 232. The user may move all of the pathology samples in the Year 0 bin to the appropriate bin in the case number range 50.

Next, the user may take the slides in each individual case number range bin, and stack the slides within that individual bin in a selected order, for example, starting with the lowest sequence number in that bin and finishing with the highest sequence number. The user may then perform a similar stacking for the slides in each remaining bin.

The user may then aggregate the stacked slides from the fourth set of bins in the selected order in the aggregation area 60. The aggregation area may be a single large area or a number of bins or collection trays 62, 64 and 66, as shown in the figure. When this process is complete, each slide in the aggregation area 60 will have an asset identification portion indicating the same Prefix, the same Decade and the same Year, and all of the slides will be in accession number order.

Once the user has aggregated all of the pathology sample slides, the user may repeat portions of the above described process, or iterate the process until all the pathology samples have been aggregated as described. For example, the user may repeat the steps for each Year of the third set of bins until all the individual years are cleared. Then the user may further repeat the steps for each Decade 30, as shown by the arrows 222, 224 and 226, and then for each Prefix 20, as shown by arrows 212, 214 and 216. Then repeating for the different types of pathology samples, for example blocks and slides as in this described example, or for other types of pathology samples, for example, test tubes, Petri dishes, vials, and documents.

It should be understood that the illustrated flow of FIG. 2 is provided by way of example only. In other arrangements, the dividers and the flow may occur in a different direction, for example from right to left, or front to back, or vertically.

It should be further understood that the Interfiler apparatus is constructed and arranged to provide a clean, soft surface that will accommodate slides, blocks vials and other sample types. In some arrangements, the dividers may define ridges that prevent an inadvertent spill of materials, and creating individual trays that may be detached and moved individually if needed.

FIG. 2 has been described as a top view of the Interfiler apparatus in accordance with a horizontal configuration having a support structure in the form of a workbench or as laid out on a table, but the invention is not so limited and any sort of support structure may be used in any sort of configuration or orientation. While the relative sizes of the bins in the figures are used for illustrative purposes, for example with the (Prefix) bins of the first set of bins larger than the (Decade) bins of the second set of bins (and thus able to hold more pathology assets at any one time), and the decade bins are shown larger than the Year bins, which are shown as larger than the case number range bins, the invention is not so limited, and the sizes of the bins may be adjusted to meet the need.

Figure 3:
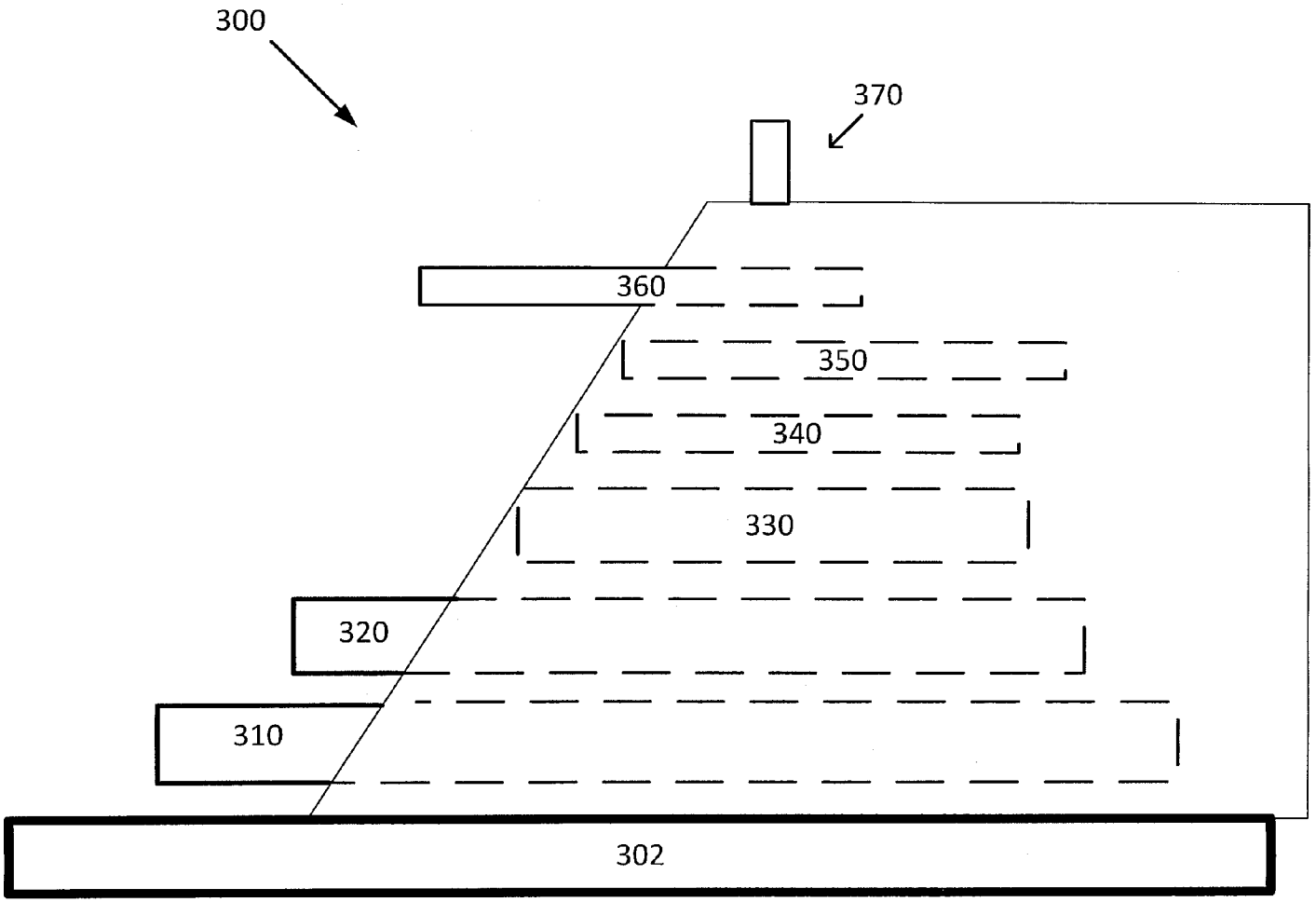
FIG. 3 is a side view of an illustrative non horizontal sorting apparatus.

FIG. 3 is a side view of an illustrative sorting apparatus 10 provided in an non-horizontal arrangement. The figure shows a cabinet style support structure 300 place upon a horizontal surface 302 with sliding drawers 310, 320, 330, 340, 350 and 360. The cabinet is shown as having a front surface with an approximate 45 degree angle from the horizontal embodiment previously disclosed, but the invention is not limited to any particular orientation. Each sliding drawer represents a set of bins and is shown as having a three-dimensional form (that is side walls on all four sides) to reliably and securely hold the pathology samples. Fixtures may be used in each drawer or set of bins to hold various types of pathology samples, for example, slots to hold slides or clips to hold vials. Such an arrangement 300 is also clearly suited for a vertical configuration, for example in the form of a wall or shelves. Each shown set of bins may be arranged in a horizontal fashion, and thus not visible in the figure except for the one bin that is closest to the viewer.

One possible advantage of a vertical or partially vertical sorting apparatus 300 is that the lower bins 310 may be open at the same time as some of the upper bins 320 for easier pathology sample movement and accuracy. For example the group of bins 310 may be equivalent to the Prefix 20 bins shown in FIG. 2, while the bins 320 may be equivalent to the decade bins, and so on for year bins 330 (shown in the closed configuration in FIG. 3) and for the case number range bins 340 and 350, and for the aggregation area bin or bins 360. FIG. 3 shows a directory 370 facing the user, who in this example is sitting or standing to the left. Method of using the apparatus of FIG. 3 is similar to that previously shown with regard to FIG. 2.

Figure 4:
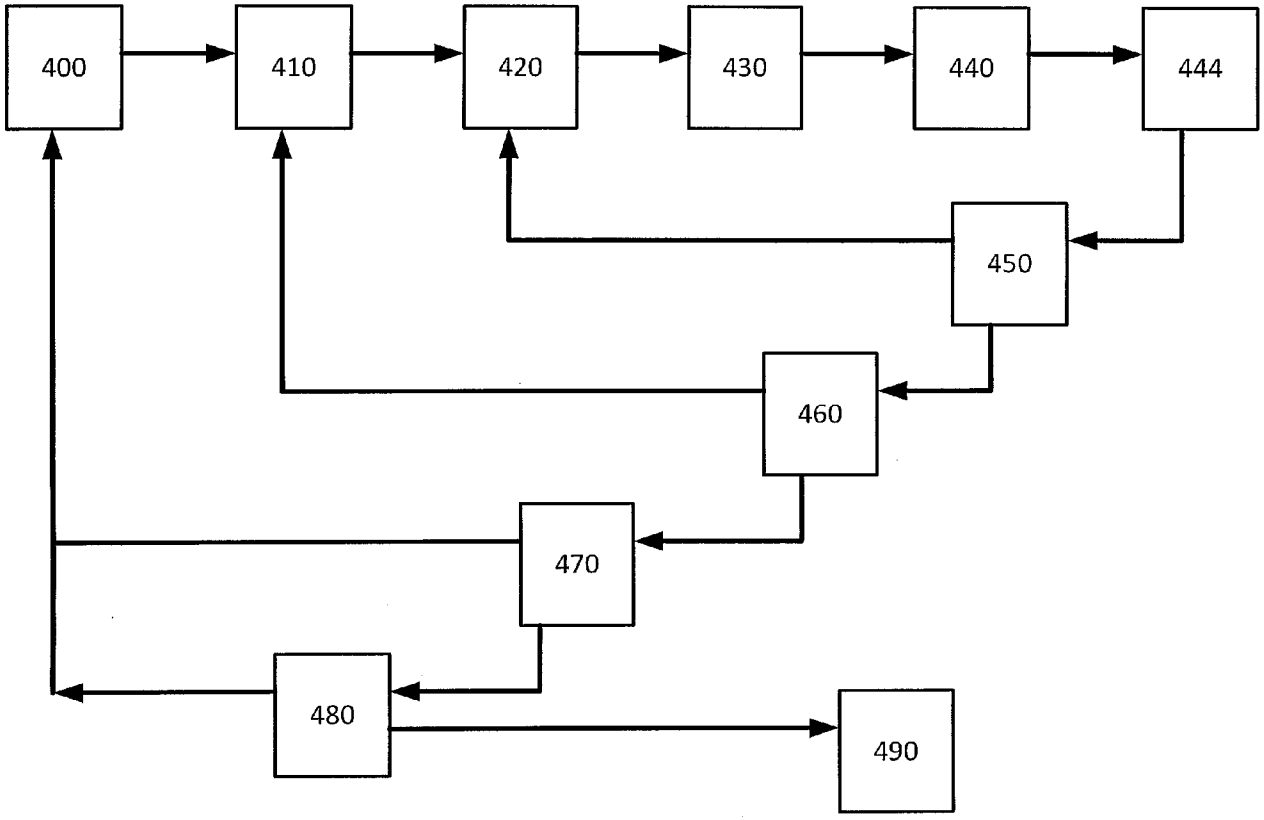
FIG. 4 is a flow chart of an illustrative method for sorting.

FIG. 4 is a flow chart of an illustrative method for sorting in accordance with the present disclosure. The described method is only one of many possible methods for using the sorting apparatus shown in the first three figures.

At step 400 a number of pathology samples are selected for moving into a first bin of the first set of bins, for example moving all slides marked SU from location 12 to bin SU 22 as shown by arrow 202 in FIG. 2.

At step 410 a number of pathology samples are moved from the first bin SU 22 to a first bin of the second set of bins, for example moving all slides from the SU 22 bin that have dates greater than 2010 into the first decade designation bin marked 2010s as shown by arrow 212 in FIG. 2.

At step 420 a number of pathology samples are moved from the first decade designation bin to a first bin of the third set of bins, for example moving all the slides having a date of exactly 2010 in the Decade 30 bin to the Year bin marked year 0, as shown by arrow 222 in FIG. 2.

At step 430 all of the pathology samples in the Year 0 bin are distributed among the case number range bins that match the case number ranges of the pathology samples, as shown by arrow 232 in FIG. 2. Arrow 232 is a single arrow that represents all of the samples in bin year 0 being moved to the corresponding case number range bin.

At step 440 the pathology samples in each individual one of the case number range bins are arranged in an order based upon the accession number.

At step 444 the pathology slides are arranged in the aggregation area, or in one of the collection trays 62, 64 and 66, as shown in FIG. 2, in particular by the representative arrow 242. At this point all of the surgery slides having an origin date in the year 2010 range, are arranged together with other pathology samples that have the same accession number in illustrative collection tray 64.

At step 450 the method returns to the step 420 and moves the pathology samples in the first Decade bin to a second bin of the third set of bins, for example the Year 1 bin, and the method continues until at step 450 it determines that there are no remaining pathology slides in the Decade bin labeled 2010s. If there are no remaining pathology samples in the first Decade bin labeled 2010s, then step 450 moves to step 460.

At step 460 the method returns to step 410 and moves the pathology samples in the Prefix bin SU 22 that are labeled for Decade designation bin labeled 2000s to bin 32 as shown by arrow 214 in FIG. 2, and the method continues until at step 460 it determines that there are no remaining pathology slides in any of the Decade bins. At this point all of the pathology slides in the SU 22 bin should be gone, sorted and aggregated, and the method moves to step 470.

At step 470 the method returns to step 400 and moves pathology slides from the original location 12 to the second bin of the first set of bins, in this example the CY 24 bin. The method then repeats until at step 460 it determines that there are no remaining pathology slides in any of the prefix designation bins. At this point the process moves to step 480.

At step 480 it is determined whether or not there are any remaining pathology samples at location 12 of FIG. 2, and if there are no further pathology samples to sort, the process ends at step 490. If there are further pathology samples, for example there may be block samples remaining after all the slide samples are sorted, then the method returns to step 400. The described method may be referred to as a linear repeating process.

Figure 5:
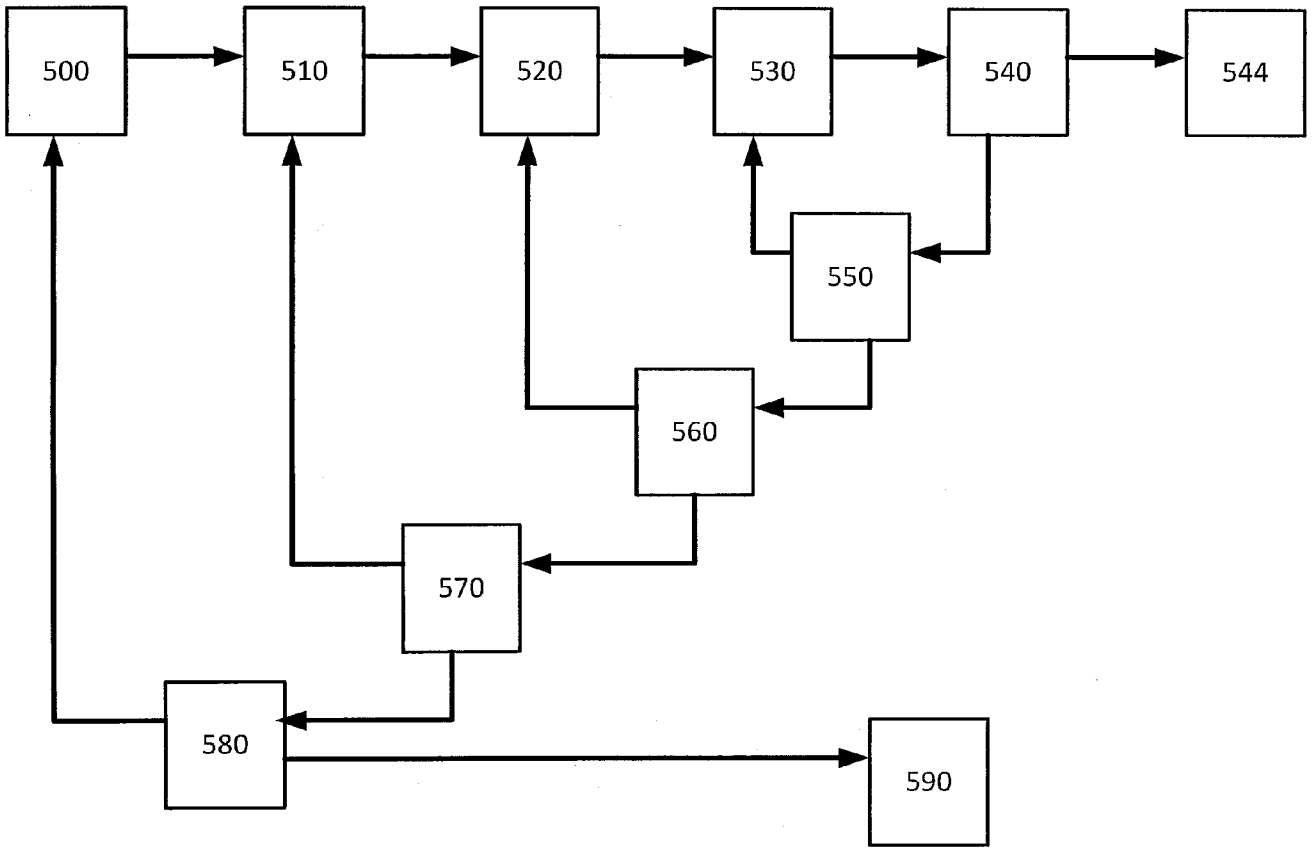
FIG. 5 is a flow chart of another illustrative method for sorting in accordance with the present disclosure.

FIG. 5 is a flow chart of another illustrative method for sorting in accordance with the present disclosure. This method may be referred to as a parallel iterative method.

At step 500 all of the pathology samples at original location 12 in FIG. 2 are sorted and moved into the corresponding prefix designation bins of the first set of bins, as shown by arrows 202, 204 and 206 of FIG. 2.

At step 510 all of the pathology samples in one bin of the first set of bins, for example bin SU 22, are moved to the corresponding Decade bins of the second set of bins, as shown by arrows 212, 214 and 216 of FIG. 2.

At step 520 all of the pathology samples in one Decade bin of the second set of bins, for example the bin labeled 2010s, are moved to the corresponding Year bins of the third set of bins, as shown by arrows 222, 224 and 226 of FIG. 2.

At step 530 all of the pathology samples in one Year bin of the third set of bins, for example the bin labeled Year 0 of FIG. 2, are distributed among corresponding case number range bins of the fourth set of bins, as shown by representative arrow 232.

At step 540 the pathology samples in each individual case number range bin are arranged in an order based upon the accession number and all of the pathology samples in the accession number range bins are moved in order to the aggregation area, or to a collection tray, for example 64, as shown by representative arrow 242 of FIG. 2.

At step 544 all of the pathology samples that are from the same prefix, the same decade and year, are stacked together with pathology samples having the same accession number, and may be then arranged in numerical order, and may be filed or re-filed.

At step 550 it is determined if all of the Year bins are empty. If there are still pathology samples in any of the Year bins, the method returns to a different Year bin and repeats the process until there are no remaining pathology samples in the Year bins. Then the method moves to step 560.

At step 560 it is determined if all the Decade bins are empty. Note that in this example the bin labeled 2010 is now empty. If all the Decade bins are empty then the method moves to step 570. If there are still pathology samples in any of the Decade bins the method returns to step 520 and repeats until all the Decade bins are empty and moves to step 570.

At step 570 it is determined if all the prefix designation bins are empty. Note that in this example the bin labeled SU 22 is now empty. If all the prefix designation bins are empty then method moves to step 580. If there are still pathology samples in any of the prefix designation bins the method returns to step 510 and repeats until all the prefix designation bins are empty and moves to step 580.

At step 580 it is determined if there are any pathology samples remaining at the original location 12 in FIG. 2. For example the initial sorting may have been limited to slide samples and there may block or vial samples remaining. If there are remaining pathology samples at location 12 in FIG. 2 then the method returns to step 500 and repeats until there are no remaining pathology samples, and moves to step 590 and ends.

In an example, the methods of FIGS. 4 and 5 are performed manually by a human operator; however, the methods may also be performed in an automated or semi-automated manner, e.g., using a robot.

Based on the above-provided descriptions, one should appreciate that there are numerous check points that prevent errors. Moreover, the Interfiler apparatus 10 reduces the time it takes to sort through the materials in an effective and competent manner.

As mentioned above, an improved technique of organizing pathology assets involves utilization of an Interfiler apparatus which facilitates performance of an iterative sorting operation which sorts pathology assets into smaller subgroups in a robust and reliable manner. The Interfiler apparatus includes different sets of dividers which enable a user to arrange the assets based on different sorting criteria (e.g., by Prefix, by Decade, by Year, etc.) for efficient and error free storage and retrieval. In an iterative manner, the user transfers the assets from larger groupings to smaller groupings using the dividers until the user has gathered the assets into the smaller subgroups in an aggregation area ready for storage. The user is then able to combine the organized materials, and safely store the organized materials in an error free manner for subsequent retrieval. Using such a technique, the user does not need to rely on memory of accession numbers, or inconsistent and unstructured attempts to manually group material.

While various embodiments of the invention have been particularly shown and described, it will be understood by those skilled in the art that various changes in form and details may be made therein without departing from the spirit and scope of the invention as defined by the appended claims.

What is claimed is:

1. A method of organizing pathology assets, the method comprising:

receiving a group of pathology assets, each pathology asset including (i) a sample portion which stores a pathology sample and (ii) an asset identification portion which identifies that pathology asset among other pathology assets;

performing an iterative sorting operation to sort the group of pathology assets into smaller subgroups; and based on results of the iterative sorting operation, storing the smaller subgroups in respective container files;

wherein the iterative sorting operation includes:

distributing the pathology assets of the group of pathology assets among a set of first dividers based on application of a first sorting criteria to the asset identification portions of the pathology assets to separate the group of pathology assets into subgroups, and distributing a subgroup of pathology assets from one of the first dividers among a set of second dividers based on application of a second sorting criteria to the asset identification portions of the pathology assets to separate the subgroup of pathology assets into the smaller subgroups.

2. The method of claim 1, wherein, when receiving the group of pathology assets, each asset identification portion for a pathology asset includes information for distributing that pathology asset into one of a plurality of subgroups, each subgroup covering a different value range of the asset identification portion.

3. The method of claim 2, wherein each asset identification portion further includes information for distributing that pathology asset into one of a plurality of subgroups in a predetermined format and order.

4. The method of claim 3, wherein the asset identification portion further includes an asset source code, an asset decade code, an asset year code, and an asset case number.

5. The method of claim 4, wherein performing the iterative sorting operation includes the steps of:

A) sorting the group of pathology assets using asset identification portion into a first set of subgroups having a same asset source code;

B) sorting a selected one of the first set of subgroups into a second set of subgroups each having a different range of the asset decade code;

C) sorting a selected one of the second set of subgroups into a third set of subgroups each having a different range of the asset year code;

D) sorting a selected one of the third set of subgroups into a fourth set of subgroups each having a different range of the asset case number; and E) repeating steps A-D until the group of pathology assets are sorted.

6. The method of claim 5, further including ordering the group of pathology assets in a low-to-high sequence of the asset case number and placing the pathology assets in the order sequence in a storage container.

7. A method of organizing samples, the method comprising:

receiving a set of samples, each sample having a unique identification label including values of a set of sorting criteria;

performing an iterative sorting operation to sort the set of samples into smaller subgroups; and storing the smaller subgroups in a set of containers based upon results of the iterative sorting operation, wherein the iterative sorting operation includes:

distributing the set of samples based on application of a first sorting criteria to the unique identification label values to sort the set of samples into a first set of subgroups;

distributing samples from one of the first set of subgroups among a second set of subgroups based on application of a second sorting criteria to the unique identification label values to sort the first set of subgroups into the second set of subgroups;

distributing samples from one of the second set of subgroups among a third set of subgroups based on application of a third sorting criteria to the unique identification label values to sort the second set of subgroups into the third set of subgroups; and repeating the iterative sorting operation until the set of samples is sorted.

* * * * *